US010380963B2

(12) United States Patent
Zheng et al.

(10) Patent No.: US 10,380,963 B2
(45) Date of Patent: Aug. 13, 2019

(54) DISPLAY DRIVING CIRCUIT, DRIVING METHOD THEREOF, AND DISPLAY DEVICE

(71) Applicants: BOE TECHNOLOGY GROUP CO., LTD., Beijing (CN); HEFEI BOE OPTOELECTRONICS TECHNOLOGY CO., LTD., Anhui (CN)

(72) Inventors: Liangliang Zheng, Beijing (CN); Tingting Jin, Beijing (CN)

(73) Assignees: BOE TECHNOLOGY GROUP CO., LTD., Beijing (CN); HEFEI BOE OPTOELECTRONICS TECHNOLOGY CO., LTD., Anhui (CN)

( * ) Notice: Subject to any disclaimer, the term of this patent is extended or adjusted under 35 U.S.C. 154(b) by 0 days.

(21) Appl. No.: 15/735,976

(22) PCT Filed: Apr. 11, 2017

(86) PCT No.: PCT/CN2017/080077

§ 371 (c)(1),
(2) Date: Dec. 13, 2017

(87) PCT Pub. No.: WO2017/185974

PCT Pub. Date: Nov. 2, 2017

(65) Prior Publication Data

US 2018/0174542 A1 Jun. 21, 2018

(30) Foreign Application Priority Data

Apr. 25, 2016 (CN) ..... 2016 1 0262856

(51) Int. Cl.

| | |
|---|---|
| ***G09G 3/36*** | (2006.01) |
| ***G09G 3/00*** | (2006.01) |
| *G09G 3/32* | (2016.01) |

(52) U.S. Cl.

CPC ..... *G09G 3/3677* (2013.01); *G09G 3/006* (2013.01); *G09G 3/32* (2013.01);
(Continued)

(58) Field of Classification Search

None

See application file for complete search history.

(56) References Cited

U.S. PATENT DOCUMENTS

| | | | |
|---|---|---|---|
| 7,995,012 | B2 | 8/2011 | Yanai et al. |
| 8,237,641 | B2 | 8/2012 | Yanai et al. |

(Continued)

FOREIGN PATENT DOCUMENTS

| | | | |
|---|---|---|---|
| CN | 1991949 | A | 7/2007 |
| CN | 101276528 | A | 10/2008 |

(Continued)

OTHER PUBLICATIONS

Search Report and Written Opinion for International Application No. PCT/CN2017/080077 dated Jun. 28, 2017.

(Continued)

*Primary Examiner* — Kenneth B Lee, Jr.

(74) *Attorney, Agent, or Firm* — Calfee, Halter & Griswold LLP

(57) ABSTRACT

The present application includes a display driving circuit, driving method thereof, and display device. A voltage detection circuit is added to an existing display drive circuit, and the voltage detection circuit determines, according to a standard reference voltage signal outputted by a logic circuit, whether a reference voltage signal outputted by a power supply management circuit is abnormal. If the reference voltage signal is determined to be abnormal, the power supply management circuit is controlled to stop outputting the reference voltage signal, such that the power supply
(Continued)

management circuit is in a static mode, and therefore, a display panel is in a constant white or constant black mode.

20 Claims, 6 Drawing Sheets

(52) U.S. Cl.
CPC ..... *G09G 2310/0286* (2013.01); *G09G 2310/0289* (2013.01); *G09G 2310/0294* (2013.01); *G09G 2310/061* (2013.01); *G09G 2330/021* (2013.01); *G09G 2330/04* (2013.01); *G09G 2330/12* (2013.01)

(56) References Cited

U.S. PATENT DOCUMENTS

| | | | | |
|---|---|---|---|---|
| 8,416,230 | B2 | 4/2013 | Goder | |
| 8,441,420 | B2 | 5/2013 | Kim et al. | |
| 9,152,197 | B2 | 10/2015 | Liu | |
| 9,292,853 | B2 | 3/2016 | Ascarrunz | |
| 2006/0061525 | A1 | 3/2006 | Kim et al. | |
| 2007/0146254 | A1 | 6/2007 | Yanai et al. | |
| 2010/0141633 | A1 | 6/2010 | Goder | |
| 2011/0285305 | A1 | 11/2011 | Yanai et al. | |
| 2012/0175953 | A1* | 7/2012 | Ohkawa | B60L 3/0046 307/18 |
| 2013/0221339 | A1 | 8/2013 | Kim et al. | |
| 2015/0026486 | A1 | 1/2015 | Liu | |
| 2015/0339975 | A1 | 11/2015 | Liu | |
| 2016/0111042 | A1* | 4/2016 | Pyeon | G09G 3/3208 345/212 |

FOREIGN PATENT DOCUMENTS

| | | | | |
|---|---|---|---|---|
| CN | 101383129 | * | 3/2009 | G09G 3/3677 |
| CN | 101383129 | A | 3/2009 | |
| CN | 104093257 | A | 10/2014 | |
| CN | 104167181 | A | 11/2014 | |
| CN | 104331141 | A | 2/2015 | |
| CN | 105304050 | A | 2/2016 | |
| CN | 105679230 | A | 6/2016 | |
| CN | 106486041 | A | 3/2017 | |
| CN | 106531071 | A | 3/2017 | |
| CN | 106531080 | A | 3/2017 | |
| CN | 206301579 | U | 7/2017 | |
| CN | 206301580 | U | 7/2017 | |
| WO | 2010/77687 | A1 | 7/2010 | |

OTHER PUBLICATIONS

First Office Action for Chinese Patent Application No. 201610262856.5 dated Dec. 21, 2017.
First Office Action for Chinese Patent Application No. 201611247392.7 dated Sep. 28, 2017.
Search Report and Written Opinion for International Application No. PCT/CN2017/089214 dated Sep. 4, 2017.

* cited by examiner

DISPLAY DRIVING CIRCUIT, DRIVING METHOD THEREOF, AND DISPLAY DEVICE

CROSS-REFERENCE OF RELATED APPLICATION

The present invention is based upon International Application No. PCT/CN2017/080077, filed on Apr. 11, 2017, which claims the benefits of Chinese patent application No. 201610262856.5 titled "DISPLAY DRIVING CIRCUIT, DRIVING METHOD THEREOF, AND DISPLAY DEVICE", which was filed with the SIPO on Apr. 25, 2016, the entire contents of which are fully incorporated herein by reference as part of this application.

TECHNICAL FIELD

The present disclosure relates to a display driving circuit, a driving method thereof, and a display device.

BACKGROUND

In recent year, with the flourishing development of semiconductor technology, portable electronic products as well as flat panel display products have also been raised. A flat panel display usually is consisted of pixel matrixes arranged in both vertical direction and horizontal direction. When performing display function, the flat panel display generates gate input signals through a shift register and scans each row of pixels in an order from a first row to a last row. In designing the flat panel display, it needs to design an appropriate shift register to ensure stable operation thereof. Usually, the shift register is comprised of multiple stages of shift register units which are connected in series, and an output signal of a previous stage of shift register unit is used as an input signal of a subsequent stage of shift register unit.

SUMMARY

In view of this, the embodiments of the present disclosure provide a display driving circuit, a driving method thereof, and a display device which are intended to solve the problems in existing display driving chips that: a gate driver control signal mismatched with a voltage required by a GOA in a display panel may be output and cause product anomaly.

Therefore, the embodiment of the present disclosure provides a display driving circuit, including: a power supply management circuit, a logic circuit and a voltage detection circuit. A first output terminal of the logic circuit is connected to a first input terminal of the power supply management circuit, and a second output terminal of the logic circuit is connected to a first input terminal of the voltage detection circuit; an output terminal of the power supply management circuit is connected to a second input terminal of the voltage detection circuit; and an output terminal of the voltage detection circuit is connected to a second input terminal of the power supply management circuit. The logic circuit is configured to output a standard reference voltage signal to the voltage detection circuit, and output a control signal to the power supply management circuit; the control signal is configured to control the power supply management circuit to output a reference voltage signal. The voltage detection circuit is configured to control the power supply management circuit to stop outputting the reference voltage signal, upon determining that the received reference voltage signal output by the power supply management circuit is abnormal according to the standard reference voltage signal output by the logic circuit.

As an implementation way, in the above-mentioned display driving circuit provided by the embodiment of the present disclosure, the output terminal of the voltage detection circuit is connected to a first input terminal of the logic circuit. The voltage detection circuit is further configured to control the logic circuit to stop outputting the control signal, upon determining that the received reference voltage signal output by the power supply management circuit is abnormal according to the standard reference voltage signal output by the logic circuit.

As an implementation way, the above-mentioned display driving circuit provided by the embodiment of the present disclosure further includes a reset circuit. The output terminal of the voltage detection circuit is connected to the second input terminal of the power supply management circuit and the first input terminal of the logic circuit, respectively, through the reset circuit. The voltage detection circuit is configured to send a warning signal to the reset circuit, upon determining that the received reference voltage signal output by the power supply management circuit is abnormal according to the standard reference voltage signal output by the logic circuit. The reset circuit is configured to send a standby signal to the power supply management circuit and the logic circuit, respectively, to control the power supply management circuit and the logic circuit to be in a standby state, respectively, upon receiving the warning signal.

As an implementation way, in the above-mentioned display driving circuit provided by the embodiment of the present disclosure, the voltage detection circuit includes a sampling circuit connected to the output terminal of the power supply management circuit and a comparison circuit connected to the logic circuit. The sampling circuit is configured to convert the reference voltage signal into a digital signal and output the digital signal to the comparison circuit, upon receiving the reference voltage signal. The comparison circuit is configured to compare the digital signal with the standard reference voltage signal as received, and send the warning signal to the reset circuit upon determining that a difference between the digital signal and the standard reference voltage signal is outside a threshold range.

As an implementation way, in the above-mentioned display driving circuit provided by the embodiment of the present disclosure, the comparison circuit is further configured to send a normal signal different from the warning signal to the reset circuit, upon determining that the difference between the digital signal and the standard reference voltage signal is within the threshold range.

As an implementation way, in the above-mentioned display driving circuit provided by the embodiment of the present disclosure, the warning signal is a high level signal, and the normal signal is a low level signal.

As an implementation way, in the above-mentioned display driving circuit provided by the embodiment of the present disclosure, the voltage detection circuit includes a sampling circuit connected to the output terminal of the power supply management circuit, and a comparison circuit connected to the logic circuit. The sampling circuit is configured to convert the reference voltage signal into a digital signal and output the digital signal to the comparison circuit, upon receiving the reference voltage signal. The comparison circuit is configured to compare the digital signal with the standard reference voltage signal as received, and send a standby signal to the power supply management circuit and the logic circuit, respectively, to control the power supply management circuit and the logic circuit to be in a standby state, respectively, upon determining that a difference between the digital signal and the standard reference voltage signal is outside a threshold range.

As an implementation way, in the above-mentioned display driving circuit provided by the embodiment of the present disclosure, the comparison circuit is further configured to send a normal signal to the power supply management circuit and the logic circuit, respectively, to control the power supply management circuit and the logic circuit to be in an operating state, respectively, upon determining that the difference between the digital signal and the standard reference voltage signal is within the threshold range.

As an implementation way, the above-mentioned display driving circuit provided by the embodiment of the present disclosure further includes a level conversion circuit; a first input terminal of the level conversion circuit is connected to the output terminal of the power supply management circuit, a second input terminal of the level conversion circuit is connected to a third output terminal of the logic circuit, and an output terminal of the level conversion circuit is connected to a shift register signal output port. The level conversion circuit is configured to generate and output a gate driver control signal according to a high-voltage power supply signal sent from the logic circuit and the reference voltage signal sent from the power supply management circuit.

As an implementation way, in the above-mentioned display driving circuit provided by the embodiment of the present disclosure, the reference voltage signal includes a low-voltage reference voltage signal and a high-voltage reference voltage signal.

The embodiment of the present disclosure further provides a driving method of the above-mentioned display driving circuit, including: the logic circuit outputs a standard reference voltage signal to the voltage detection circuit; the power supply management circuit outputs a reference voltage signal to the voltage detection circuit; the voltage detection circuit determines whether the reference voltage signal as received is abnormal according to the standard reference voltage signal as received; if the reference voltage signal is abnormal, then the voltage detection circuit controls the power supply management circuit to stop outputting the reference voltage signal, and if the reference voltage signal is normal, then the power supply management circuit operates normally.

As an implementation way, the above-mentioned method provided by the embodiment of the present disclosure further includes: if the reference voltage signal is abnormal, then the voltage detection circuit further controls the logic circuit to stop outputting the control signal.

The embodiment of the present disclosure provides a display device, including: a display panel integrated with a shift register; and any of the above-mentioned display driving circuits provided by the embodiments of the present disclosure.

As an implementation way, in the above-mentioned display device provided by the embodiment of the present disclosure, the display panel is a liquid crystal display panel or an electroluminescence display panel.

The display driving circuit, the driving method thereof and the display device provided by several embodiments of the present disclosure additionally incorporates a voltage detection circuit into an existing display driving circuit; the voltage detection circuit can determine whether a reference voltage signal output by a power supply management circuit is abnormal or not according to a standard reference voltage signal output by a logic circuit, and can control the power supply management circuit to stop outputting the reference voltage signal upon determining the reference voltage signal is abnormal, so as to bring the power supply management circuit into a standby mode where the display panel is in a normally white mode or a normally black mode, which avoids a possible scenario that a gate driver control signal mismatched with a voltage required by a shift register of the display panel is input into the shift register, and hence prevents assembled display products from involving any anomaly due to the mismatch of the output signal of the display driving circuit and the display panel.

BRIEF DESCRIPTION OF THE DRAWINGS

The drawings herein are incorporated in and constitute a part of the specification, showing embodiments consistent with the present disclosure and, together with the description, serve to explain the principles of the present disclosure and without limiting the present disclosure in any way. In the drawings.

DETAILED DESCRIPTION

Hereinafter, specific implementations of the display driving circuit, the driving method thereof and the display device provided by the embodiments of the present disclosure will be described in more details with reference to the drawings. The following embodiments are provided to describe the technical solution of the present disclosure more clearly, and should not be construed as any limitation to the scope of the present disclosure.

Figure 1:
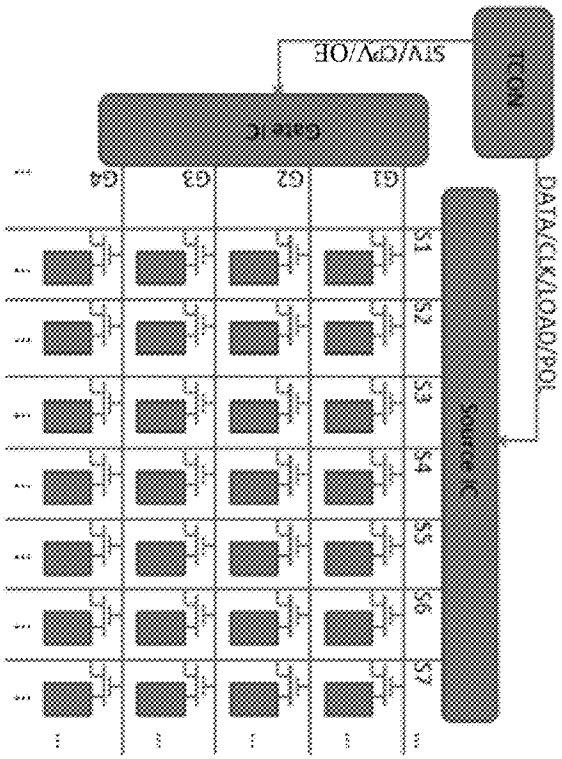
FIG. 1 is a structural schematic diagram of a flat panel display in the prior art.

As illustrated in FIG. 1, a shift register may be disposed in a gate driver chip (Gate IC); after the system transmits image information to a timer control register (TCON), the TCON outputs a STV/CPV/OE signal to the Gate IC to control the Gate IC; the Gate IC controls gate lines G1, G2, G3, G4 . . . in the display panel to be turned on row by row according to the above-mentioned signal; the TCON outputs a DATA/CLK/LOAD/POL signal to a source driver chip (Source IC), and the Source IC inputs a respective data signal to each data line of data lines S1, S2, S3, S4, S5, S6, S7 . . . in the display panel according to the above-mentioned signal.

Figure 2:
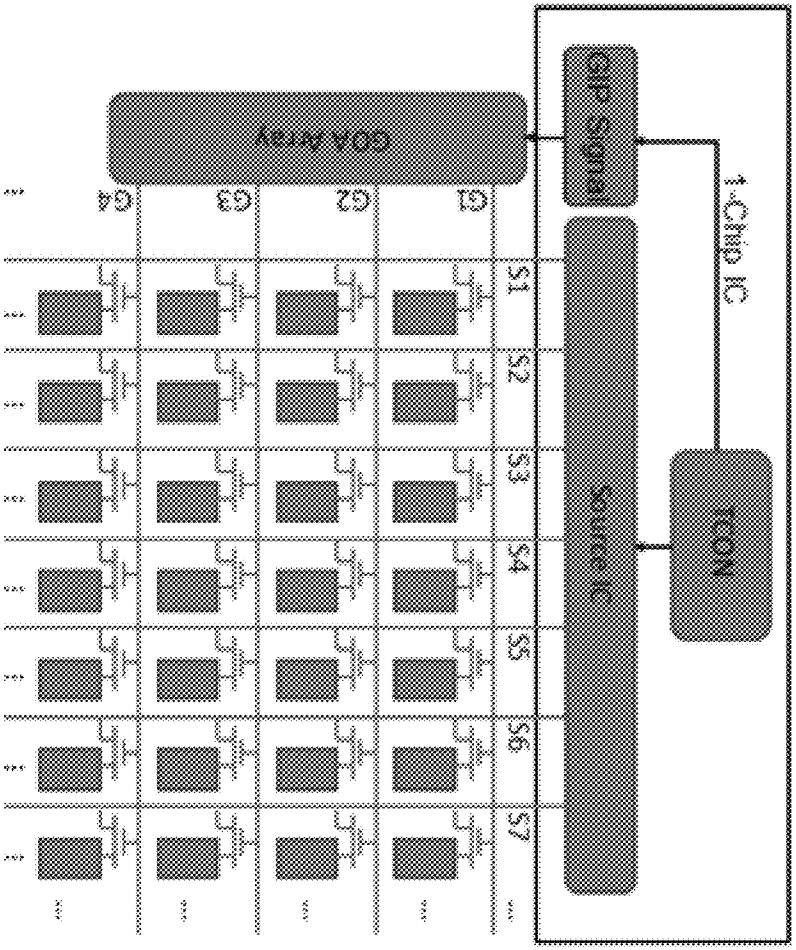
FIG. 2 is another structural schematic diagram of the flat panel display in the prior art.

Currently, in order to reduce manufacturing costs of flat panel displays, manufactures in the industry directly fabricate a multi-stage amorphous silicon shift register on a substrate of the display panel to replace the above-mentioned Gate IC, so as to achieve the objective of reducing the manufacturing cost of the display panel. As illustrated in FIG. 2, when the shift register is integrated in the display panel (GOA Array), the gate driver, the TCON and the source IC may be integrated in a single chip (1-Chip IC) which may be referred to as a display driver chip. The 1-Chip IC is further configured to provide a gate driver control signal (GIP Signal) to the GOA Array, as well as inputting a respective data signal to each data line of the data lines S1 . . . S7 in the display panel.

Due to the fact that GOA models in the display panels designed by various panel manufactures may be more or less different, requirements for the voltage of the GIP Signals may be different from each other, and therefore the problem of the GIP Signal output by the 1-Chip IC mismatching with the voltage required by the GOA in the display panel may occur, which may cause abnormal products obtained upon assembling the 1-Chip IC with the display panel, and may involve quality risks if such products flow to external client terminals.

Figure 3:
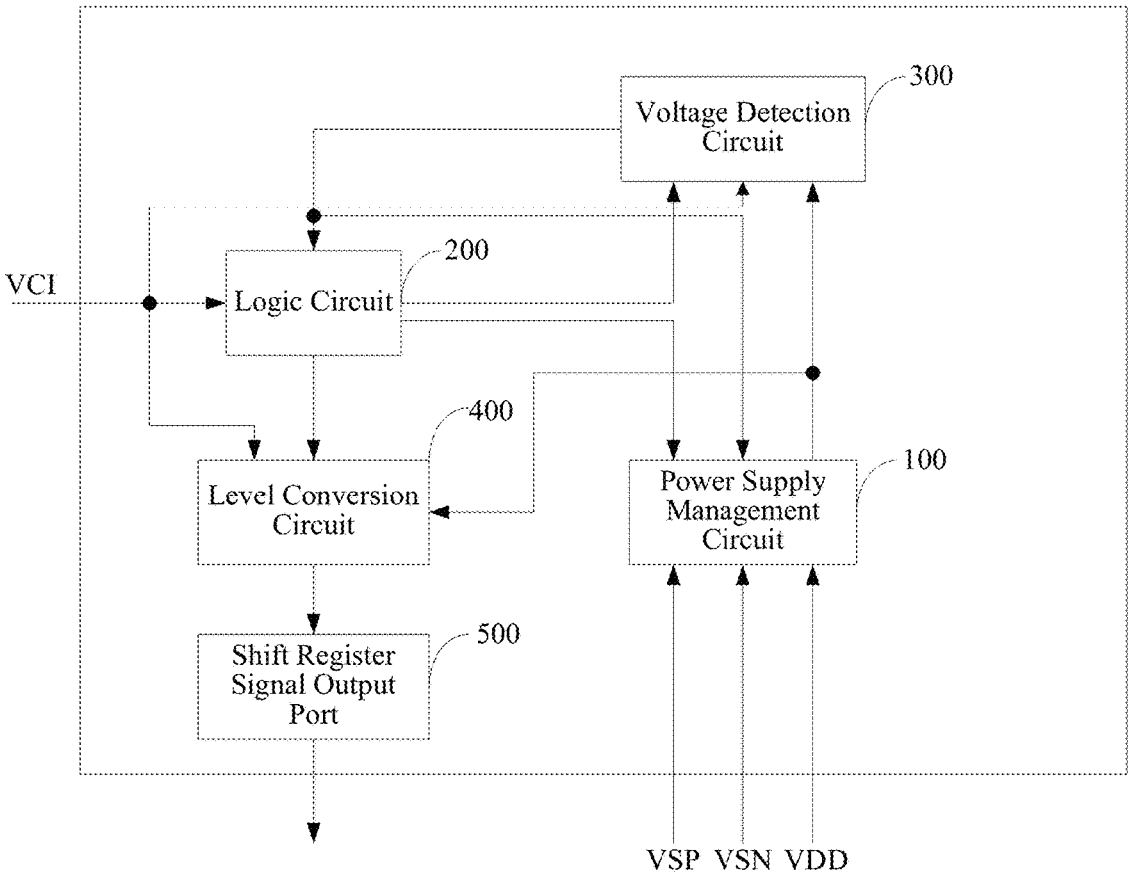
FIG. 3 is a structural schematic diagram of a display driving circuit provided by an embodiment of the present disclosure.

The embodiment of the present disclosure provides a display driving circuit. As illustrated in FIG. 3, the display driving circuit includes: a power supply management circuit 100, a logic circuit 200 and a voltage detection circuit 300. A first output terminal of the logic circuit 200 is connected to a first input terminal of the power supply management circuit 100, and a second output terminal of the logic circuit 200 is connected to a first input terminal of the voltage detection circuit 300; an output terminal of the power supply management circuit 100 is connected to a second input terminal of the voltage detection circuit 300; and an output terminal of the voltage detection circuit 300 is connected to a second input terminal of the power supply management circuit 100.

The logic circuit 200 is configured to output a standard reference voltage signal to the voltage detection circuit 300, and output a control signal to the power supply management circuit 100; the control signal is configured to control the power supply management circuit 100 to output a reference voltage signal.

The voltage detection circuit 300 is configured to control the power supply management circuit 100 to stop outputting the reference voltage signal, upon determining the received reference voltage signal output by the power supply management circuit 100 is abnormal according to the standard reference voltage signal output by the logic circuit 200.

The above-mentioned display driving circuit provided by the embodiment of the present disclosure additionally incorporates a voltage detection circuit 300 into an existing display driving circuit. The voltage detection circuit 300 can determine whether a reference voltage signal output by a power supply management circuit 100 is abnormal or not according to a standard reference voltage signal output by a logic circuit 200, and can control the power supply management circuit 100 to stop outputting the reference voltage signal upon determining the reference voltage signal is abnormal, so as to bring the power supply management circuit 100 into a standby mode where the display panel is in a normally white mode or a normally black mode, which avoids a possible scenario that a gate driver control signal mismatched with a voltage required by a shift register of the display panel is input into the shift register, and hence prevents assembled display products from involving any anomaly due to the mismatch of the output signal of the display driving circuit and the display panel.

In practical implementations, as illustrated in FIG. 3, the above-mentioned display driving circuit provided by the embodiment of the present disclosure usually further includes a level conversion circuit 400; a first input terminal of the level conversion circuit 400 is connected to the output terminal of the power supply management circuit 100, a second input terminal of the level conversion circuit 400 is connected to a third output terminal of the logic circuit 200, and an output terminal of the level conversion circuit 400 is connected to a shift register signal output port 500. The level conversion circuit 400 is configured to generate a gate driver control signal (GIP signal) according to a high-voltage power supply signal from the logic circuit 200 and the reference voltage signal from the power supply management circuit 100, and then output the GIP signal to a GOA circuit on the display panel so as to provide a control signal to the GOA circuit.

In practical implementations, in the above-mentioned display driving circuit provided by the embodiment of the present disclosure, the power supply management circuit 100 may receive various power supply signals from system chips, such as power supply VDD signal, +5V power supply VSN signal, and −5V power supply VSP signal as illustrated in FIG. 3; and then generate all logic voltage signals required by an interior of the display driving circuit according to the control signal sent from the logic circuit 200, for example, a reference voltage signal that may be generated and sent to the level conversion circuit 400. Furthermore, as illustrated in FIG. 3, in the display driving circuit, other circuits (including the logic circuit 200, the voltage detection circuit 300 and the level conversion circuit 400) except for the power supply management circuit 100, may further receive a low-voltage power supply VCI signal which is input from outside of the display driving circuit, and the VCI signal is configured to provide a power supply signal to the circuits connected thereto. In more details, the reference voltage signal usually includes a low-voltage reference voltage signal VGL and a high-voltage reference voltage signal VGH.

In practical implementations, the standard reference voltage signal mentioned in the embodiments of the present disclosure may be a low-voltage reference voltage generated from a low-voltage power supply VCI signal, e.g., a reference voltage of 0.9V, 1.0V, 1.1V and the like, and details of the circuits generating the reference voltage may refer to contents disclosed in existing technologies without particularly repeating herein. However, the above values are illustrative only, and the present disclosure is not intended to be limited thereto.

In practical implementations, in the above-mentioned display driving circuit provided by the embodiment of the present disclosure, as illustrated in FIG. 3, in addition to the reference voltage signal sent from the power supply management circuit 100, the level conversion circuit 400 may further receive a high-voltage power supply signal sent from the logic circuit 200. As a result, when the voltage detection circuit 300 determines that the reference voltage signal generated by the power supply management circuit 100 is abnormal, in order to ensure that the level conversion circuit 400 will not generate the GIP signal and send the same to the shift register signal output port 500, the voltage detection circuit 300 may be further configured to control the logic circuit 200 to stop outputting the control signal upon determining that the received reference voltage signal output by the power supply management circuit 100 is abnormal according to the standard reference voltage signal output by the logic circuit 200, so as to bring the logic circuit 200 into a standby mode where the logic circuit 200 will not output a high-voltage power supply signal either. In such case, on one hand the power supply management circuit 100 will not receive the control signal from the logic circuit 200 and hence will not output the reference voltage signal to the level conversion circuit 400; on the other hand the level conversion circuit 400 will not receive the high-voltage power supply signal from the logic circuit 200 and hence will not generate the GIP signal, either.

Figure 4:
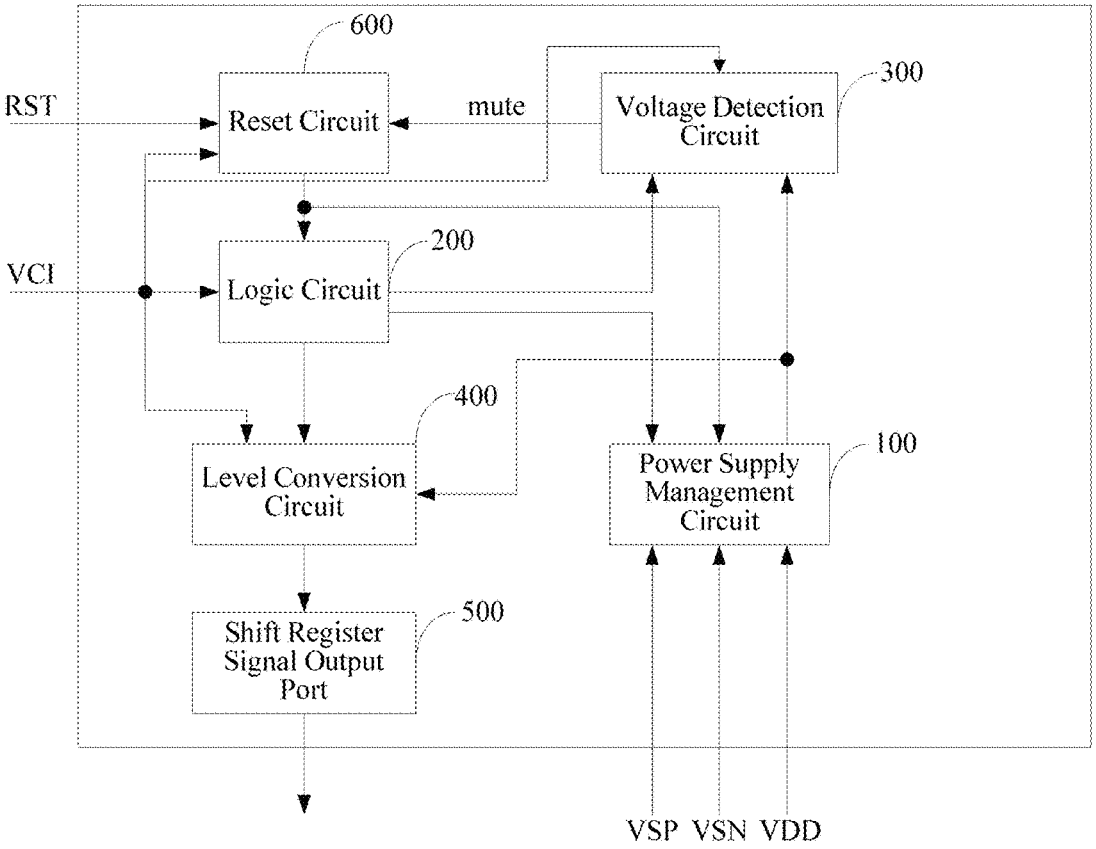
FIG. 4 is another structural schematic diagram of the display driving circuit provided by the embodiment of the present disclosure.

In addition, as illustrated in FIG. 4, the above-mentioned display driving circuit provided by the embodiment of the present disclosure may further include a reset circuit 600; and an output terminal of the voltage detection circuit 300 is connected to the second input terminal of the power supply management circuit 100 and the first input terminal of the logic circuit 200, respectively, through the reset circuit 600. In practical implementations, the voltage detection circuit 300 added to the display driving circuit is configured to control the power supply management circuit 100 and the logic circuit 200 to be in a standby state, respectively, through the reset circuit, upon detecting an anomaly in the reference voltage signal. In more details, the voltage detection circuit 300 is configured to send a warning (mute) signal to the reset circuit 600 upon determining the received reference voltage signal output by the power supply management circuit 100 is abnormal according to the standard reference voltage signal output by the logic circuit 200. The reset circuit 600 is further configured to send a standby signal to the power supply management circuit 100 and the logic circuit 200, respectively, to control the power supply management circuit 100 and the logic circuit 200 to be in a standby state, upon receiving the mute signal. The power supply management circuit 100 and the logic circuit 200 will be in a standby state upon receiving the standby signal, and will not output any signal.

The above-mentioned logic circuit 200 provided by the embodiment of the present disclosure may be a circuit with two input terminals, wherein a first input terminal of the logic circuit 200 may be defined as the one receiving the output of the reset circuit 600 for the logic circuit 200, and a second input terminal of the logic circuit 200 may be the one connected to a low-voltage power supply VCI signal. However, the present disclosure is not intended to be limited thereto.

In addition, in the above-mentioned display driving circuit provided by the embodiment of the present disclosure, as illustrated in FIG. 4, the reset circuit 600 may further receive a reset (RST) signal input from outside of the display driving circuit, and the RST signal may also trigger the reset circuit 600 to send the standby signal.

In addition, as illustrated in FIG. 4, the reset circuit may be further connected to a VCI signal, and the VCI signal may also provide a power supply signal to the reset circuit.

Figure 5:
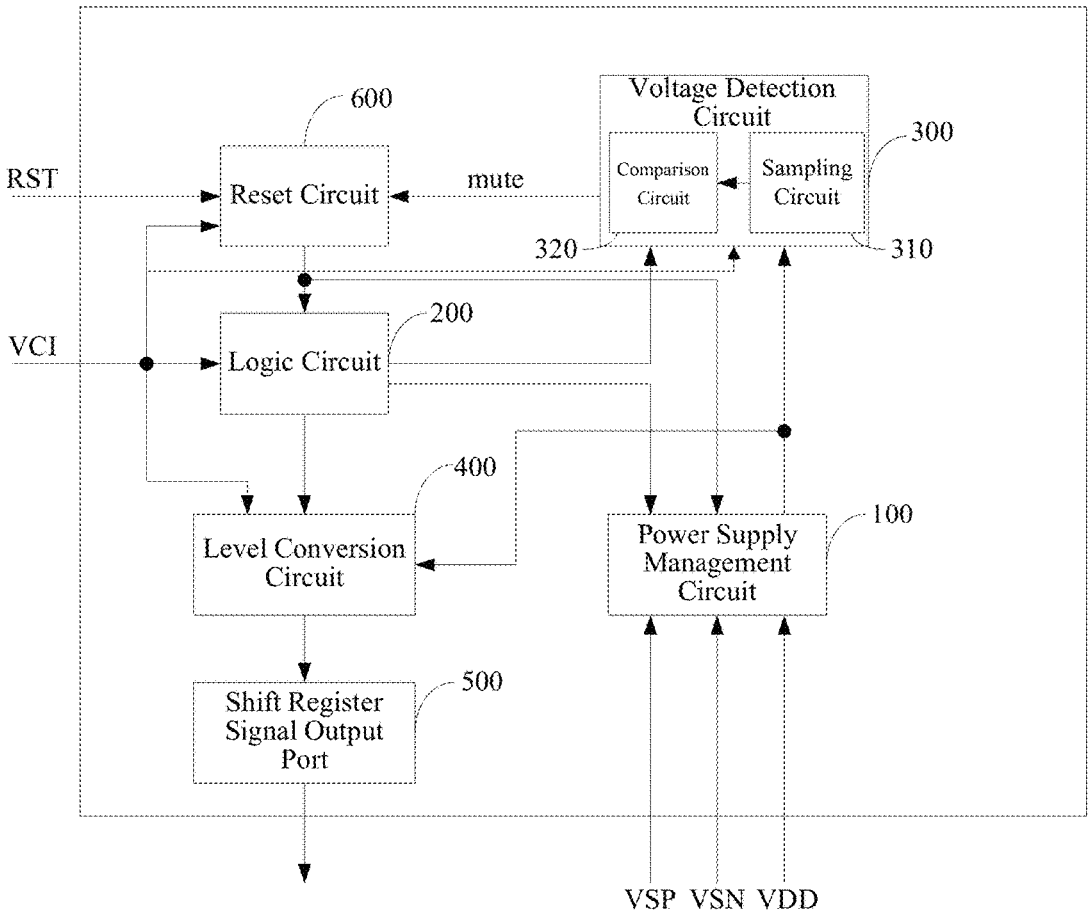
FIG. 5 is yet another structural schematic diagram of the display driving circuit provided by the embodiment of the present disclosure.

In the above-mentioned display driving circuit provided by the embodiment of the present disclosure, when the output terminal of the voltage detection circuit 300 is connected to the second input terminal of the power supply management circuit 100 and the first input terminal of the logic circuit 200, respectively, through the reset circuit 600, as illustrated in FIG. 5, the voltage detection circuit 300 may include a sampling circuit 310 connected to the output terminal of the power supply management circuit 100 and a comparison circuit 320 connected to the second output terminal of the logic circuit 200. The sampling circuit 310 is configured to convert the reference voltage signal into a digital signal and output the digital signal to the comparison circuit 320, upon receiving the reference voltage signal. The comparison circuit 320 is configured to compare the digital signal with the standard reference voltage signal as received, and send a mute signal to the reset circuit 600 upon determining that a difference between the digital signal and the standard reference voltage signal is not within a threshold range.

In an embodiment, the sampling circuit 310 samples a high-voltage reference voltage output by the power supply management circuit 100. The sampling circuit 310 contains a voltage-divider network which converts the high-voltage reference signal into a low-voltage signal. By way of example, if the standard reference voltage signal output by the logic circuit 200 is 1V and if the high-voltage reference voltage output by the power supply management circuit 100 according to design requirements has to be equal to or higher than 12V, i.e., if the high-voltage reference voltage is higher than 12V, then the voltage-divider network in the interior of the sampling circuit 310 outputs a low-voltage reference voltage higher than 1V, the voltage detection circuit 300 outputs a low level, the reset circuit 600 will not be turned on, and hence the system will be in normal operation; otherwise, the voltage detection circuit 300 outputs a high level, the reset circuit 600 will be turned on, and hence the system will be shut down.

In addition, in the above-mentioned display driving circuit provided by the embodiment of the present disclosure, the comparison circuit 320 may be further configured to send a normal signal different from the warning signal to the reset circuit 600 or not to send any signal at all, upon determining that the difference between the digital signal and the standard reference voltage signal is within the threshold range. Generally, the warning signal is a high level signal, and the normal signal is a low level signal. Upon receiving the low level signal, the reset circuit 600 will not be turned on; at this point, the power supply management circuit 100 and the logic circuit 200 both will be in normal operation, and the level conversion circuit 400 will normally send the GIP signal. Upon receiving the high level signal, the reset circuit 600 sends a standby signal to the power supply management circuit 100 and the logic circuit 200, respectively, so that the two circuits both will be in a standby mode, the level conversion circuit 400 will not output any signal, then the shift register of the display panel will be input with no signal, and hence the display panel will be in a normally white mode or a normally black mode. It should be explained that, the warning signal and the normal signal may be signals of other types, as long as they can control the reset signal to or not to normally operate.

Figure 6:
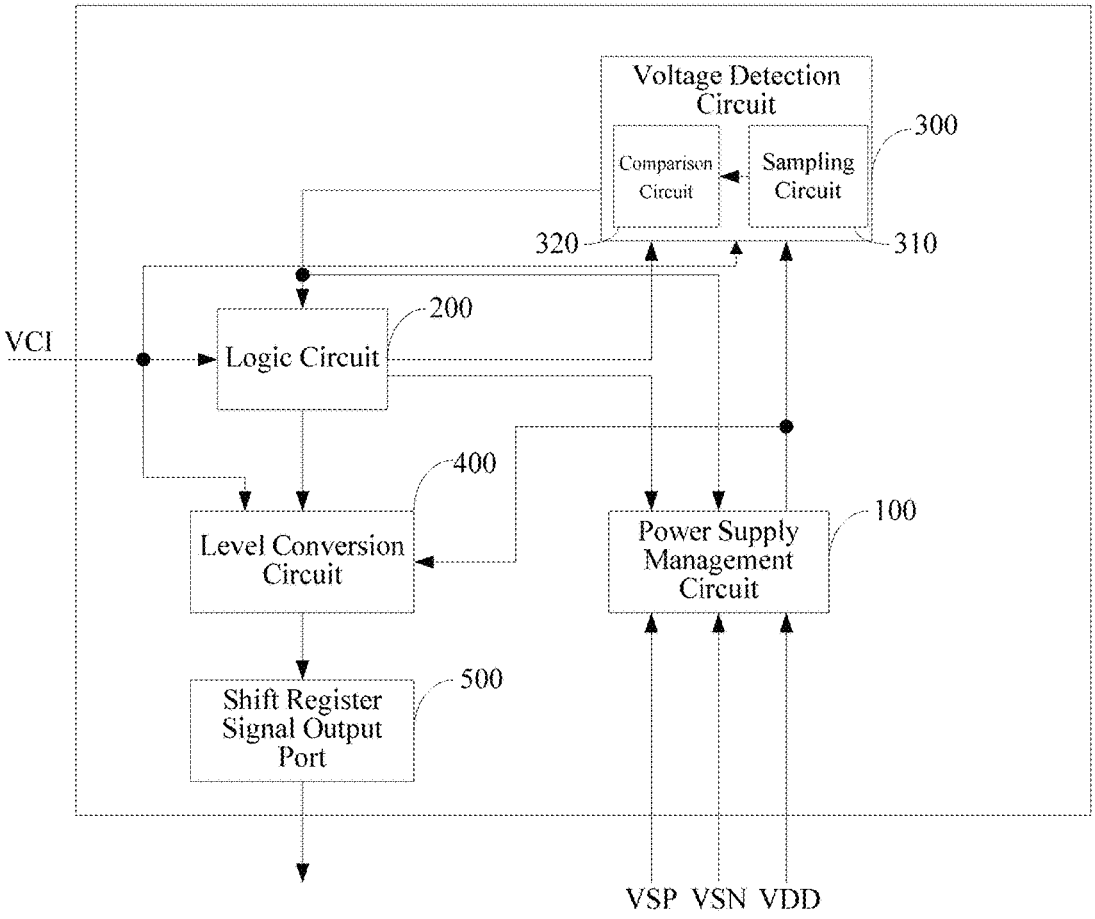
FIG. 6 is still another structural schematic diagram of the display driving circuit provided by the embodiment of the present disclosure.

In an embodiment, when the output terminal of the voltage detection circuit 300 is directly connected to the second input terminal of the power supply management circuit 100 and the first input terminal of the logic circuit 200, respectively, as illustrated in FIG. 6, the voltage detection circuit 300 may include a sampling circuit 310 connected to the output terminal of the power supply management circuit 100 and a comparison circuit 320 connected to the logic circuit 200. The sampling circuit 310 is configured to convert the reference voltage signal into a digital signal and send the digital signal to the comparison circuit 320, upon receiving the reference voltage signal. The comparison circuit 320 is configured to compare the digital signal with the standard reference voltage signal as received, and send a standby signal to the power supply management circuit 100 and the logic circuit 200, respectively, to control the power supply management circuit 100 and the logic circuit 200 to be in a standby mode, respectively, upon determining that the difference between the digital signal and the standard reference voltage signal is not within a threshold range.

In addition, in the above-mentioned display driving circuit provided by the embodiment of the present disclosure, the comparison circuit 320 may be further configured to send a normal signal to the power supply management circuit 100 and the logic circuit 200, respectively, to control the power supply management circuit 100 and the logic circuit 200 to be in an operation state, respectively, or not to send any signal at all, upon determining that the difference between the digital signal and the standard reference voltage signal is within the threshold range. Generally, the standby signal is a high level signal, and the normal signal is a low level signal. When the comparison circuit outputs a normal signal or outputs no signal at all, the power supply management circuit 100 and the logic circuit 200 both can maintain the normal operation state. Upon receiving the normal signal, the power supply management circuit 100 and the logic circuit 200 will be in normal operation, and the level conversion circuit 400 will normally send the GIP signal. Upon receiving the standby signal, the power supply management circuit 100 and the logic circuit 200 both will be in a standby mode without outputting any signal, the level conversion circuit 400 will output no signal, then the shift register of the display panel will be input with no signal, and hence the display panel will be in a normally white mode or a normally black mode. It should be explained that, the above-mentioned standby signal and the normal signal may be signals of other types, as long as they can control the power supply management circuit and the logic circuit to or not to normally operate.

Figure 7:
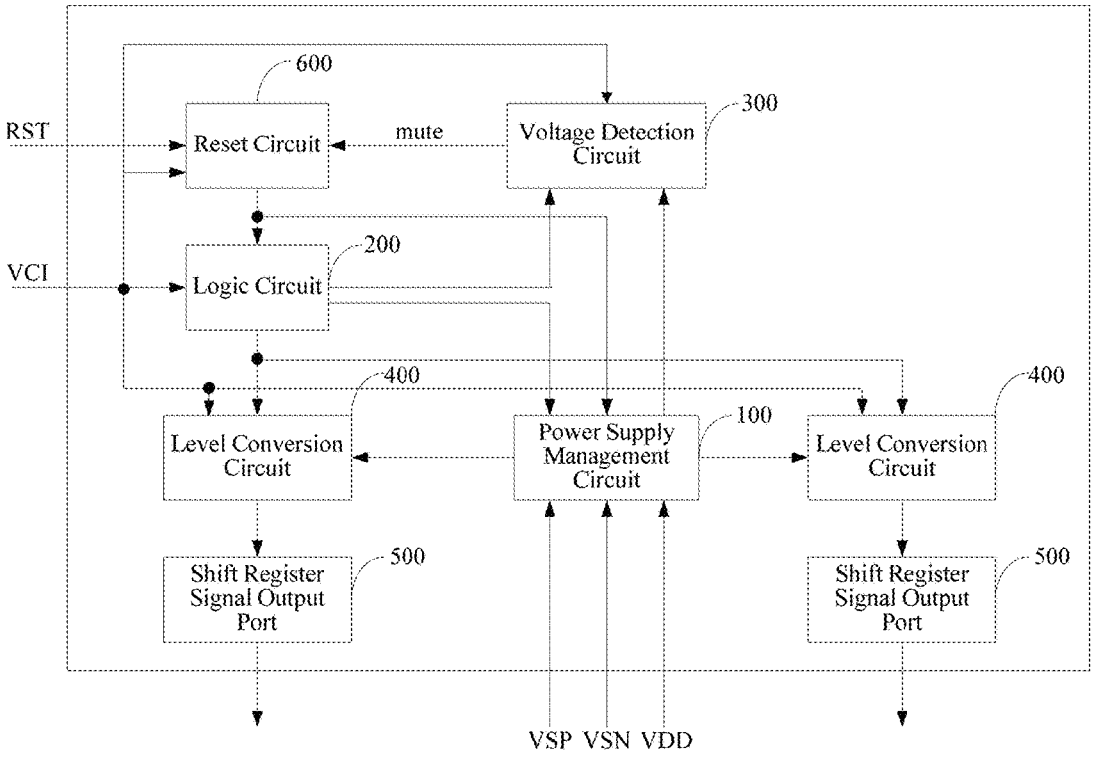
FIG. 7 is further another structural schematic diagram of the display driving circuit provided by the embodiment of the present disclosure.

In practical implementations, an amount of the level conversion circuit 400 and the shift register signal output port 500 connected thereto in the above-mentioned display driving circuit provided by the embodiment of the present disclosure may be configured according to the type of the shift register disposed in the display panel. For more details, in order to be adapted to a display panel driven by an unidirectional shift register, as illustrated in FIG. 3 and FIG. 4, the display driving circuit may be configured with a set of level conversion circuits 400 and shift register signal output ports 500; in order to be adapted to a display panel driven by a bidirectional shift register, as illustrated in FIG. 7, the display driving circuit may be configured with two sets of level conversion circuits 400 and shift register signal output ports 500.

Based on the same inventive concept, the embodiments of the present disclosure further provide a display device including the above-mentioned display driving circuit provided by the embodiment of the present disclosure as well as a display panel integrated with a shift register. The display device may be any product or component having display function such as mobile phone, tablet computer, television set, displayer, notebook computer, digital photo frame and navigator. As for the implementation of the display device, reference may be made to the foregoing embodiments of the display driving circuit, without particularly repeating herein.

In addition, in the above-mentioned display device provided by the embodiment of the present disclosure, the display panel may be a liquid crystal display panel, or may be an electroluminescence display panel, or may be display panels which adopt other light-emitting manners and utilize the shift register integrated on the display panel to generate the gate scan signal, without particularly defined herein.

The embodiment of the present disclosure further provides a driving method of the above-mentioned display driving circuit, including: the logic circuit outputs a standard reference voltage signal to the voltage detection circuit; the power supply management circuit outputs a reference voltage signal to the voltage detection circuit; the voltage detection circuit determines whether the reference voltage signal as received is abnormal according to the standard reference voltage signal as received; if the reference voltage signal is abnormal, then the voltage detection circuit controls the power supply management circuit to stop outputting the reference voltage signal, and if the reference voltage signal is normal, then the power supply management circuit operates normally.

In addition, the above-mentioned driving method further includes: if the reference voltage signal is abnormal, then the voltage detection circuit further controls the logic circuit to stop outputting the control signal.

The embodiments of the present disclosure provide a display driving circuit, a driving method thereof and a display device which additionally incorporate a voltage detection circuit into an existing display driving circuit; the voltage detection circuit can determine whether a reference voltage signal output by a power supply management circuit is abnormal or not according to a standard reference voltage signal output by a logic circuit, and can control the power supply management circuit to stop outputting the reference voltage signal upon determining the reference voltage signal is abnormal, so as to bring the power supply management circuit into a standby mode where the display panel is in a normally white mode or a normally black mode, which avoids a possible scenario that a gate driver control signal mismatched with a voltage required by a shift register of the display panel is input into the shift register, and hence prevents assembled display products from involving any anomaly due to the mismatch of the output signal of the display driving circuit and the display panel.

Obviously, those skilled in the art can make various modifications and variations to the present invention without departing from the spirit and scope of the present invention. In this way, if these modifications and variations of the present invention fall within the scope of the claims of the present invention and the equivalents, the present invention is also intended to include these modifications and variations.

What is claimed is:

1. A display driving circuit, comprising: a power supply management circuit, a logic circuit, and a voltage detection circuit, wherein a first output terminal of the logic circuit is connected to a first input terminal of the power supply management circuit, and a second output terminal of the logic circuit is connected to a first input terminal of the voltage detection circuit; an output terminal of the power supply management circuit is connected to a second input terminal of the voltage detection circuit; and an output terminal of the voltage detection circuit is connected to a second input terminal of the power supply management circuit, the logic circuit is configured to output a standard reference voltage signal to the voltage detection circuit, and to output a control signal to the power supply management circuit, the control signal is configured to control the power supply management circuit to output a reference voltage signal, and the voltage detection circuit is configured to control the power supply management circuit to stop outputting the reference voltage signal, upon determining that the received reference voltage signal output by the power supply management circuit is abnormal according to the standard reference voltage signal output by the logic circuit.

2. The display driving circuit according to claim 1, wherein the output terminal of the voltage detection circuit is connected to a first input terminal of the logic circuit; and the voltage detection circuit is further configured to control the logic circuit to stop outputting the control signal, upon determining that the received reference voltage signal output by the power supply management circuit is abnormal according to the standard reference voltage signal output by the logic circuit.

3. The display driving circuit according to claim 2, further comprising a reset circuit, wherein the output terminal of the voltage detection circuit is connected to the second input terminal of the power supply management circuit and the first input terminal of the logic circuit, respectively, through the reset circuit, the voltage detection circuit is configured to send a warning signal to the reset circuit, upon determining that the received reference voltage signal output by the power supply management circuit is abnormal according to the standard reference voltage signal output by the logic circuit, and the reset circuit is configured to send a standby signal to the power supply management circuit and the logic circuit, respectively, to control the power supply management circuit and the logic circuit to be in a standby state, respectively, upon receiving the warning signal.

4. The display driving circuit according to claim 3, wherein the voltage detection circuit comprises a sampling circuit connected to the output terminal of the power supply management circuit and a comparison circuit connected to the logic circuit, the sampling circuit is configured to convert the reference voltage signal into a digital signal and to output the digital signal to the comparison circuit, upon receiving the reference voltage signal, and the comparison circuit is configured to compare the digital signal with the standard reference voltage signal as received, and to send the warning signal to the reset circuit, upon determining that a difference between the digital signal and the standard reference voltage signal is not within a threshold range.

5. The display driving circuit according to claim 4, wherein the comparison circuit is further configured to send a normal signal different from the warning signal to the reset circuit, upon determining that the difference between the digital signal and the standard reference voltage signal is within the threshold range and the warning signal is a high level signal, and the normal signal is a low level signal.

6. The display driving circuit according to claim 2, wherein the voltage detection circuit comprises a sampling circuit connected to the output terminal of the power supply management circuit, and a comparison circuit connected to the logic circuit, the sampling circuit is configured to convert the reference voltage signal into a digital signal and to output the digital signal to the comparison circuit, upon receiving the reference voltage signal, and the comparison circuit is configured to compare the digital signal with the standard reference voltage signal as received, and to send a standby signal to the power supply management circuit and the logic circuit, respectively, to control the power supply management circuit and the logic circuit to be in a standby state, respectively, upon determining that a difference between the digital signal and the standard reference voltage signal is not within a threshold range.

7. The display driving circuit according to claim 6, wherein the comparison circuit is further configured to send a normal signal to the power supply management circuit and the logic circuit, respectively, to control the power supply management circuit and the logic circuit to be in an operating state, respectively, upon determining that the difference between the digital signal and the standard reference voltage signal is within the threshold range.

8. The display driving circuit according to claim 1, wherein the reference voltage signal comprises a low-voltage reference voltage signal and a high-voltage reference voltage signal.

9. A driving method of the display driving circuit according to claim 1, comprising:

the logic circuit outputs a standard reference voltage signal to the voltage detection circuit;

the power supply management circuit outputs a reference voltage signal to the voltage detection circuit; and the voltage detection circuit determines whether the reference voltage signal as received is abnormal according to the standard reference voltage signal as received; if the reference voltage signal is abnormal, then the voltage detection circuit controls the power supply management circuit to stop outputting the reference voltage signal, and if the reference voltage signal is normal, then the power supply management circuit operates normally.

10. The driving method according to claim 9, further comprising:

if the reference voltage signal is abnormal, then the voltage detection circuit further controls the logic circuit to stop outputting the control signal.

11. The display driving circuit according to claim 2, further comprising a level conversion circuit, wherein a first input terminal of the level conversion circuit is connected to the output terminal of the power supply management circuit, a second input terminal of the level conversion circuit is connected to a third output terminal of the logic circuit, and an output terminal of the level conversion circuit is connected to a shift register signal output port; and the level conversion circuit is configured to generate and output a gate driver control signal (GPI signal) according to a high-voltage power supply signal sent from the logic circuit and the reference voltage signal sent from the power supply management circuit.

12. The display driving circuit according to claim 3, further comprising a level conversion circuit, wherein a first input terminal of the level conversion circuit is connected to the output terminal of the power supply management circuit, a second input terminal of the level conversion circuit is connected to a third output terminal of the logic circuit, and an output terminal of the level conversion circuit is connected to a shift register signal output port; and the level conversion circuit is configured to generate and output a gate driver control signal (GPI signal) according to a high-voltage power supply signal sent from the logic circuit and the reference voltage signal sent from the power supply management circuit.

13. The display driving circuit according to claim 4, further comprising a level conversion circuit, wherein a first input terminal of the level conversion circuit is connected to the output terminal of the power supply management circuit, a second input terminal of the level conversion circuit is connected to a third output terminal of the logic circuit, and an output terminal of the level conversion circuit is connected to a shift register signal output port; and the level conversion circuit is configured to generate and output a gate driver control signal (GPI signal) according to a high-voltage power supply signal sent from the logic circuit and the reference voltage signal sent from the power supply management circuit.

14. The display driving circuit according to claim 5, further comprising a level conversion circuit, wherein a first input terminal of the level conversion circuit is connected to the output terminal of the power supply management circuit, a second input terminal of the level conversion circuit is connected to a third output terminal of the logic circuit, and an output terminal of the level conversion circuit is connected to a shift register signal output port; and the level conversion circuit is configured to generate and output a gate driver control signal (GPI signal) according to a high-voltage power supply signal sent from the logic circuit and the reference voltage signal sent from the power supply management circuit.

15. The display driving circuit according to claim 6, further comprising a level conversion circuit, wherein a first input terminal of the level conversion circuit is connected to the output terminal of the power supply management circuit, a second input terminal of the level conversion circuit is connected to a third output terminal of the logic circuit, and an output terminal of the level conversion circuit is connected to a shift register signal output port; and the level conversion circuit is configured to generate and output a gate driver control signal (GPI signal) according to a high-voltage power supply signal sent from the logic circuit and the reference voltage signal sent from the power supply management circuit.

16. A display driving circuit, comprising: a power supply management circuit, a logic circuit, a level conversion circuit, and a voltage detection circuit, wherein:

a first output terminal of the logic circuit is connected to a first input terminal of the power supply management circuit, and a second output terminal of the logic circuit is connected to a first input terminal of the voltage detection circuit; an output terminal of the power supply management circuit is connected to a second input terminal of the voltage detection circuit; and an output terminal of the voltage detection circuit is connected to a second input terminal of the power supply management circuit;

the logic circuit is configured to output a standard reference voltage signal to the voltage detection circuit, and to output a control signal to the power supply management circuit, the control signal is configured to control the power supply management circuit to output a reference voltage signal;

the voltage detection circuit is configured to control the power supply management circuit to stop outputting the reference voltage signal, upon determining that the received reference voltage signal output by the power supply management circuit is abnormal according to the standard reference voltage signal output by the logic circuit;

a first input terminal of the level conversion circuit is connected to the output terminal of the power supply management circuit, a second input terminal of the level conversion circuit is connected to a third output terminal of the logic circuit, and an output terminal of the level conversion circuit is connected to a shift register signal output port; and the level conversion circuit is configured to generate and output a gate driver control signal (GPI signal) according to a high-voltage power supply signal sent from the logic circuit and the reference voltage signal sent from the power supply management circuit.

17. A display device, comprising: a display panel integrated with a shift register, and the display driving circuit according to claim 16.

18. The display device according to claim 17, wherein the display panel is a liquid crystal display panel or an electroluminescence display panel.

19. The display device of claim 17, further comprising a single chip which comprises a timer control register and a source driver chip, where the single chip is further configured to provide the gate driver control signal to the shift register.

20. The driving method of claim 9, further comprising:

the logic circuit outputs the control signal regardless of control provided by the voltage detection circuit.

* * * * *